US007757588B2

(12) United States Patent
Chen

(10) Patent No.: US 7,757,588 B2
(45) Date of Patent: Jul. 20, 2010

(54) ADAPTER

(75) Inventor: Tai-Hung Chen, Chang Hua Hsien (TW)

(73) Assignee: Infar Industrial Co., Ltd., Chang Hua Hsien (TW)

( * ) Notice: Subject to any disclaimer, the term of this patent is extended or adjusted under 35 U.S.C. 154(b) by 0 days.

(21) Appl. No.: 12/041,905

(22) Filed: Mar. 4, 2008

(65) Prior Publication Data

US 2009/0223330 A1 Sep. 10, 2009

(51) Int. Cl.
*B25B 13/06* (2006.01)
*B25B 23/16* (2006.01)

(52) U.S. Cl. ..... 81/177.85; 81/180.1

(58) Field of Classification Search ..... 81/177.85, 81/180.1, 177.2, 176.2, 125; 403/329
See application file for complete search history.

(56) References Cited

U.S. PATENT DOCUMENTS 2,836,091 A * 5/1958 Mann ..... 81/125
2,851,295 A * 9/1958 Chaffee ..... 403/328
3,118,696 A * 1/1964 Resare ..... 403/328
5,233,891 A * 8/1993 Arnold et al. ..... 81/60
5,323,672 A * 6/1994 Skiba ..... 81/125
5,509,333 A * 4/1996 Rion ..... 81/180.1
6,681,662 B2 * 1/2004 Blackston ..... 81/451
6,684,741 B2 * 2/2004 Blackston ..... 81/451
7,017,457 B2 * 3/2006 Nessbaum et al. ..... 81/177.85
7,036,401 B2 * 5/2006 Carroll ..... 81/177.2
7,182,000 B1 * 2/2007 Dicksen ..... 81/177.2
7,261,022 B1 * 8/2007 Hsieh ..... 81/177.75
2005/0011319 A1 * 1/2005 Cho ..... 81/177.85
2007/0022847 A1 * 2/2007 Chen ..... 81/180.1
2007/0044599 A1 * 3/2007 Hsieh ..... 81/177.85

FOREIGN PATENT DOCUMENTS

TW 465432 11/1990

* cited by examiner

*Primary Examiner*—David B Thomas
(74) *Attorney, Agent, or Firm*—Rosenberg, Klein & Lee

(57) ABSTRACT

An adapter engagable in a hole of a driving end of a tool includes a body receivable in the hole. The body includes a cavity in which an elastic member and a cover can be received. The elastic element can provide a force for pushing the cover to abut against the wall of the hole such that the adapter is securely retained in the hole.

17 Claims, 10 Drawing Sheets

ADAPTER

BACKGROUND OF INVENTION

1. Field of Invention

The present invention relates to an adapter, in particular to an adapter for engaging in a hole of a driving end of a hand-tool.

2. Related Prior Art

Referring to Taiwan Patent No. 465432, a conventional adapter 30, and 40, or 50 engagable in a hole of a driving end of a wrench includes a member 35, 45, and 54 producing magnetic force between the wrench and the adapter 30, and 40, or 50 so as to achieve secure engagement therebetween. However, one problem of the adapter 30, and 40, and 50 is that the magnetic strength is dependent on the size of the member 35, 45, and 54, and the size of the member 35, 45, and 54 is dependent on the size of the adapter, therefore, the size of the magnet will effect the securing strength between the adapter and the wrench. In real, the size of the adapter is normally small. Therefore, the adapter is unable to accommodate a big sized member that provides sufficiently strong strength for secure engagement. Another problem is that if the magnet is strong, the wrench can easily be magnetized, and the metallic dust can easily be attracted. The dust could prevent the secure engagement between the wrench and the adapter will become abated.

The present invention is therefore intended to obviate or at least alleviate the problems encountered in prior art.

SUMMARY OF INVENTION

It is therefore an object of the present invention to provide an adapter that overcomes the aforementioned problems.

Accordingly, the present invention provides an adapter including a body receivable in a hole of a driving end of a tool. The body has a cavity in which an elastic member and a cover can be received. The elastic element can provide a force for pushing the cover to abut against the wall of the hole such that the adapter is securely retained in the hole.

An advantage of the present invention is that the cover a sloped edge provided for an easy assessment of the adapter in the hole of the wrench.

Another advantage of the present invention is that the elastic member is made of Ployurethane, or Polypropylene, or Polyvinylchloride, therefore, the adapter will not attract any metallic scraps or dust.

A further advantage of the present invention is that the cover defines a rim provided for securely hooking the cover in the cavity. In addition, the rim delimits a concavity in which the elastic member can be disposed.

In another embodiment, the cavity further includes an indentation 25 and the cover further includes a flange that can be received in the indentation.

In another embodiment, the elastic member takes the form a coil spring.

Other advantages, objectives and features of the present invention will become apparent from the following description referring to the attached drawings.

DETAILED DESCRIPTION OF THE PREFERRED EMBODIMENT

Figure 1:
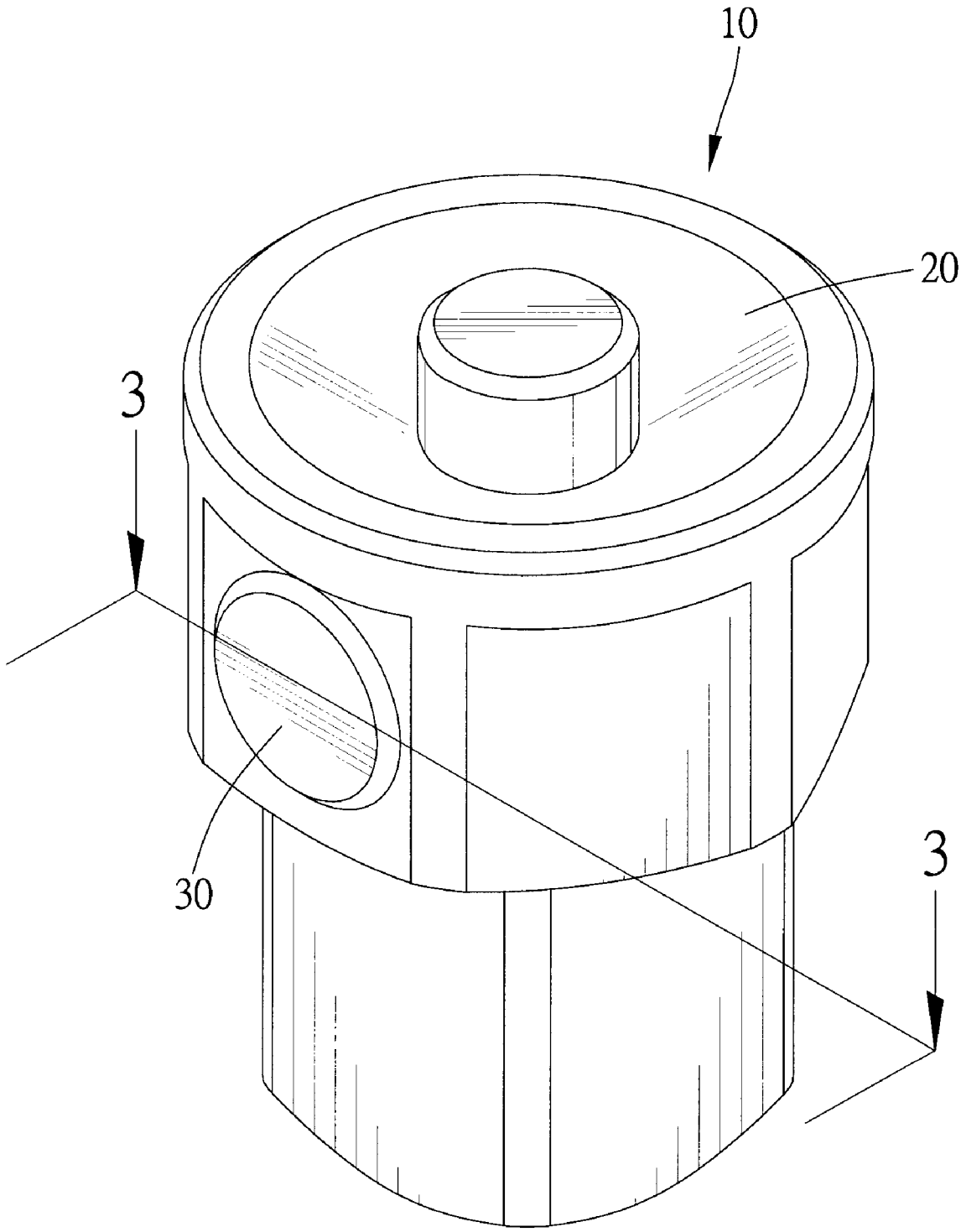
FIG. 1 is a perspective view of an adapter in accordance with a first embodiment of the present invention.
Figure 2:
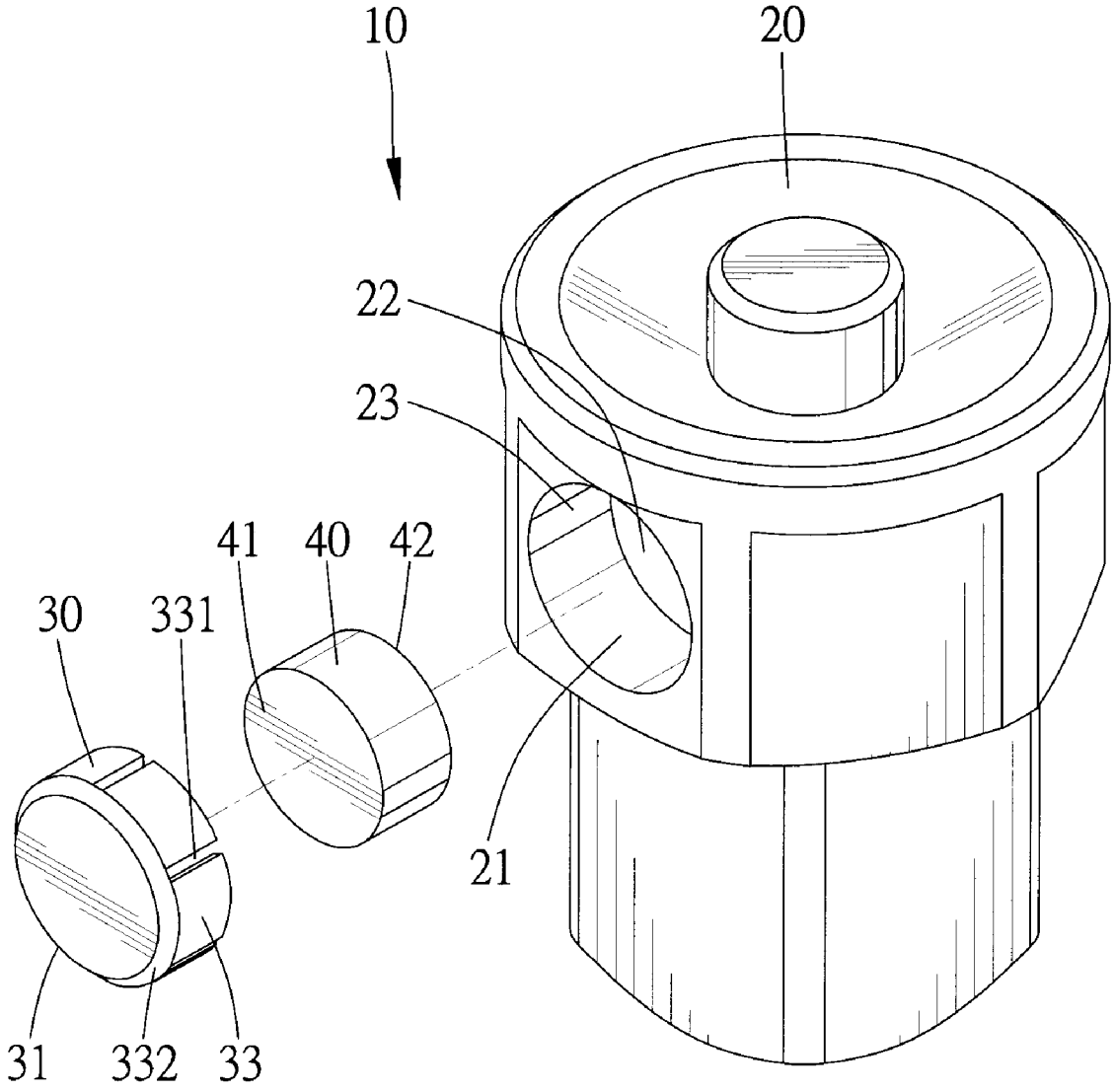
FIG. 2 is an exploded view of the adapter of FIG. 1.

Referring to FIGS. 1 through 5, an adapter 10 engagable in a hole 90 of a driving end of a wrench includes a body 20 disposed in the hole 90. The body 20 has a cavity 21 extending radially and in which an elastic member 40 and a cover 30 can be received. In this embodiment, the cavity 21 is of a circular shape, however, the cavity 21 can be of any other shape. The elastic element 40 provides a force for pushing the cover 30 to abut against the wall of the hole 90 such that the adapter 10 is securely retained in the hole 90 of the wrench.

The cover 30 defines a surface 31, a sloped edge 332 extended from the perimeter of the surface 31, and a depressible rim 33 extended from the sloped edge 332.

Figure 3:
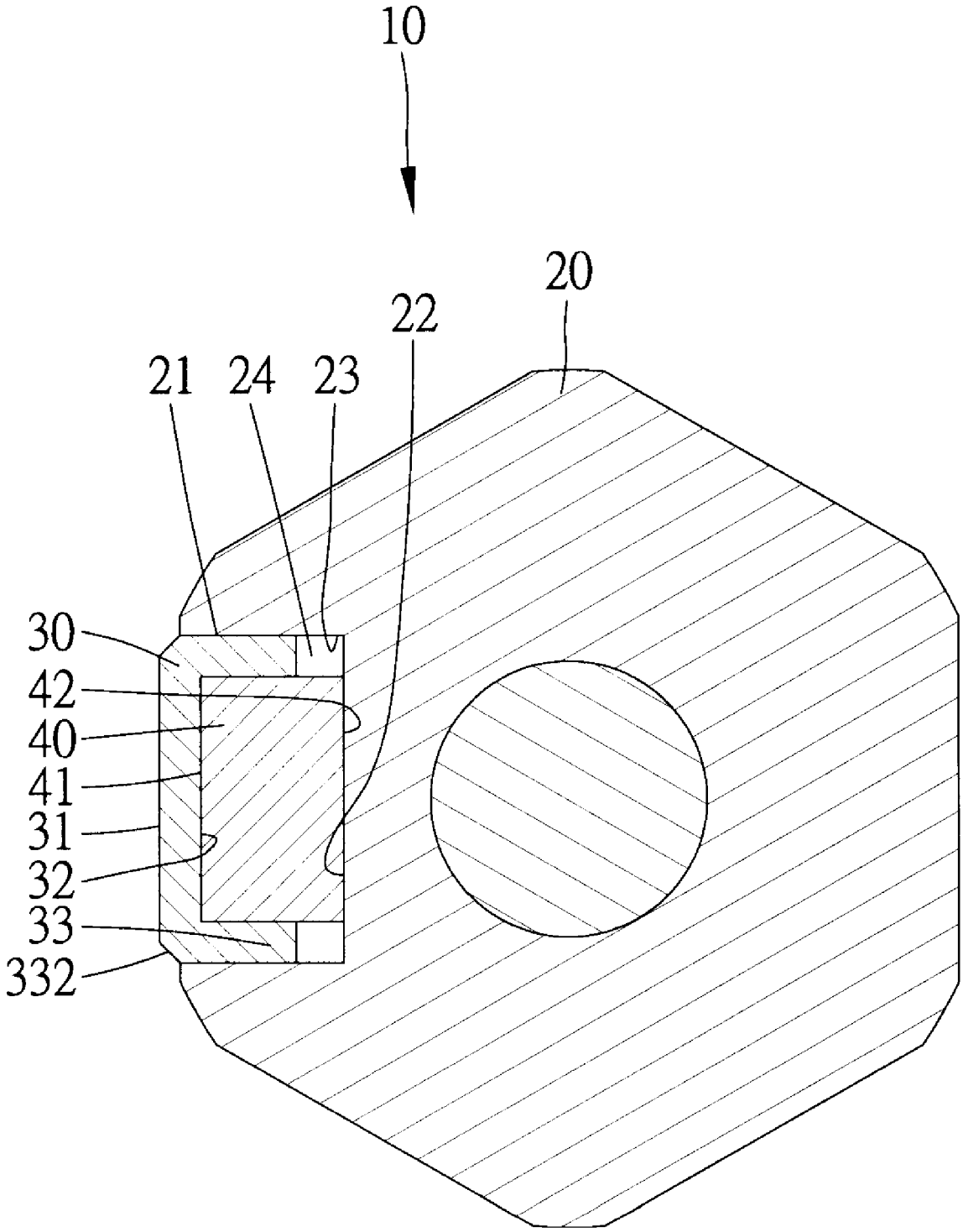
FIG. 3 is a cross-sectional view taken along line 3-3 in FIG. 1.
Figure 4:
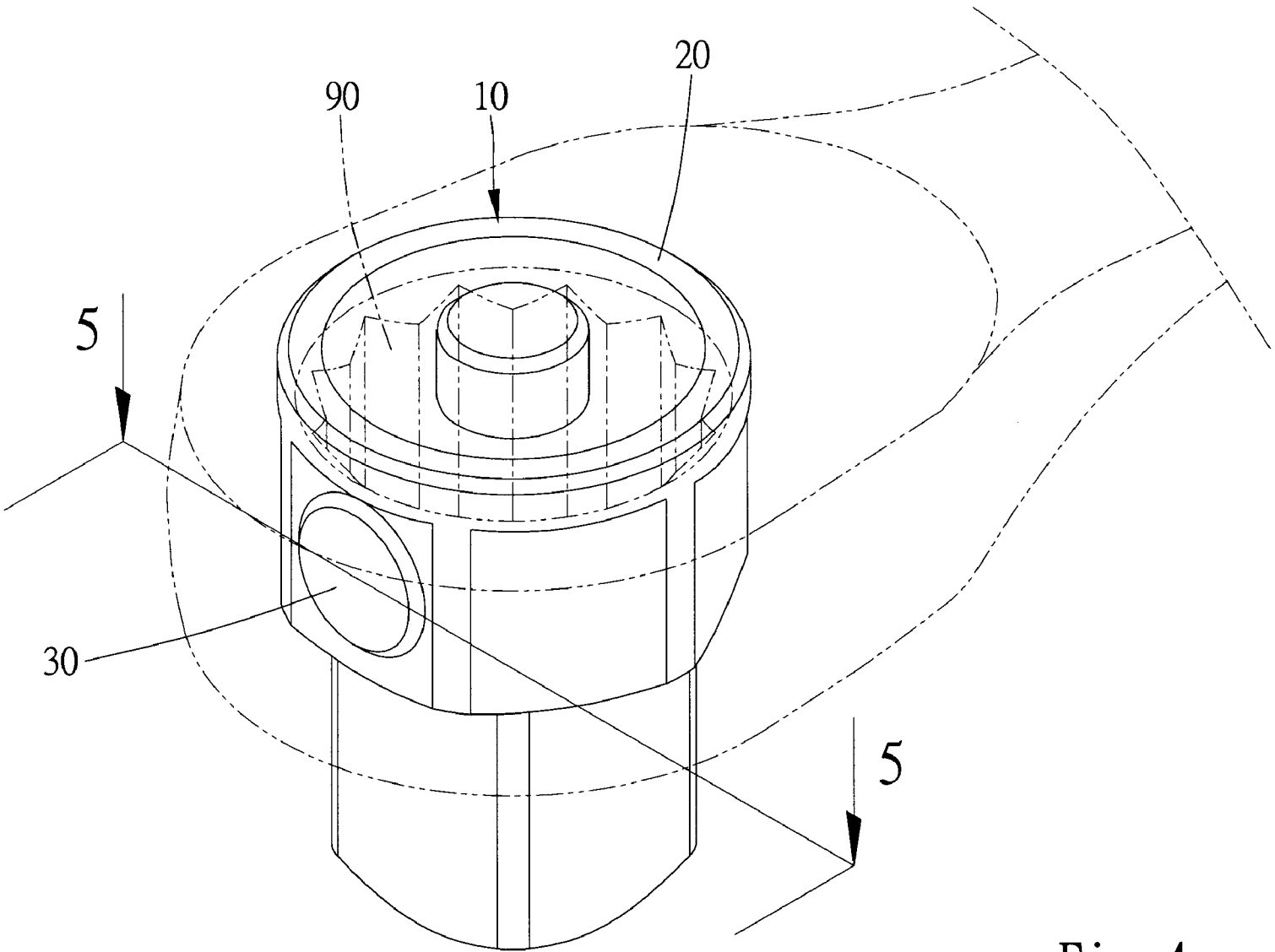
FIG. 4 is a perspective view showing the adapter of FIG. 1 in use with a wrench, with the wrench shown in phantom.
Figure 5:
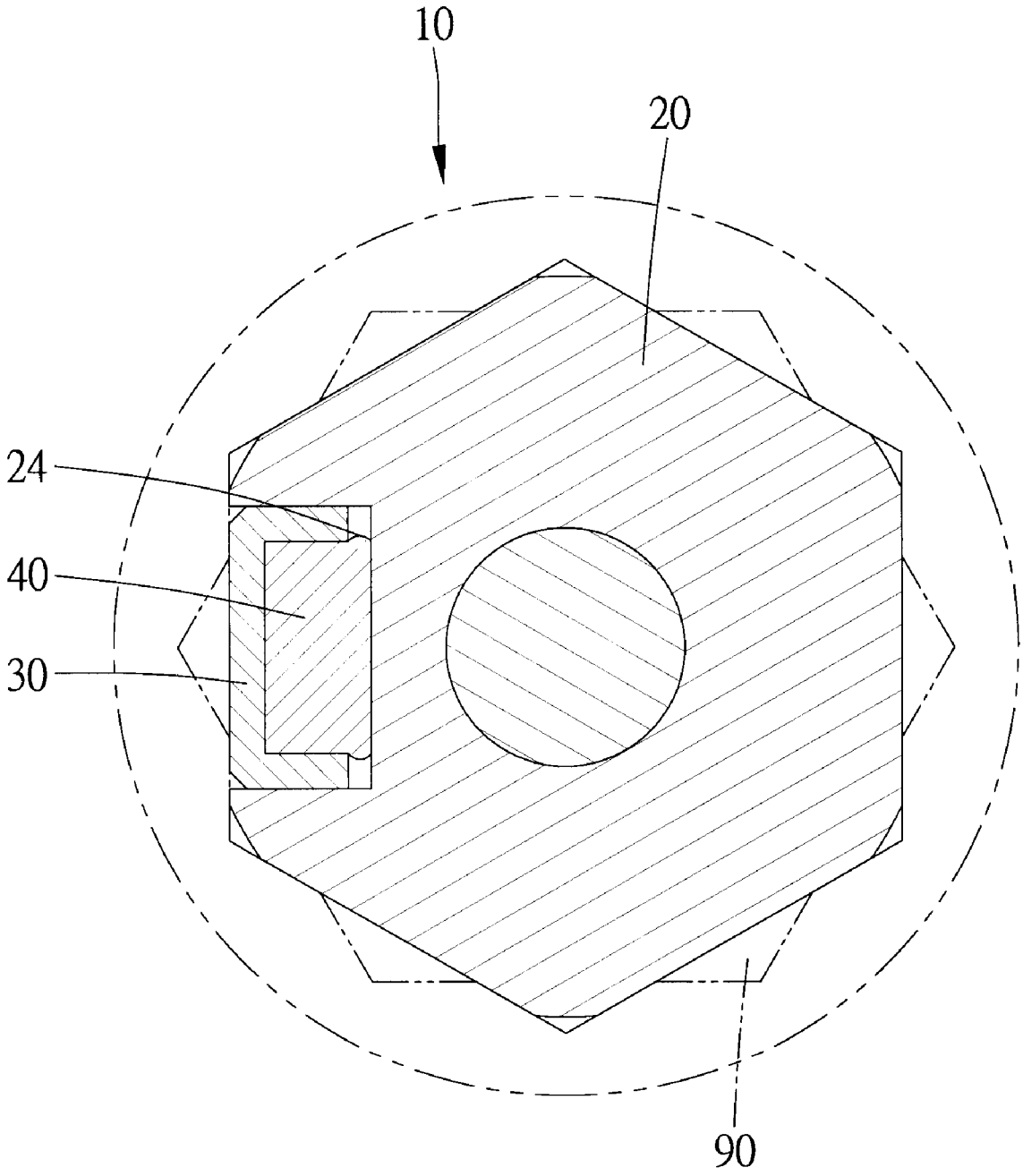
FIG. 5 is a cross-sectional view taken along line 5-5 in FIG. 4.
Figure 6:
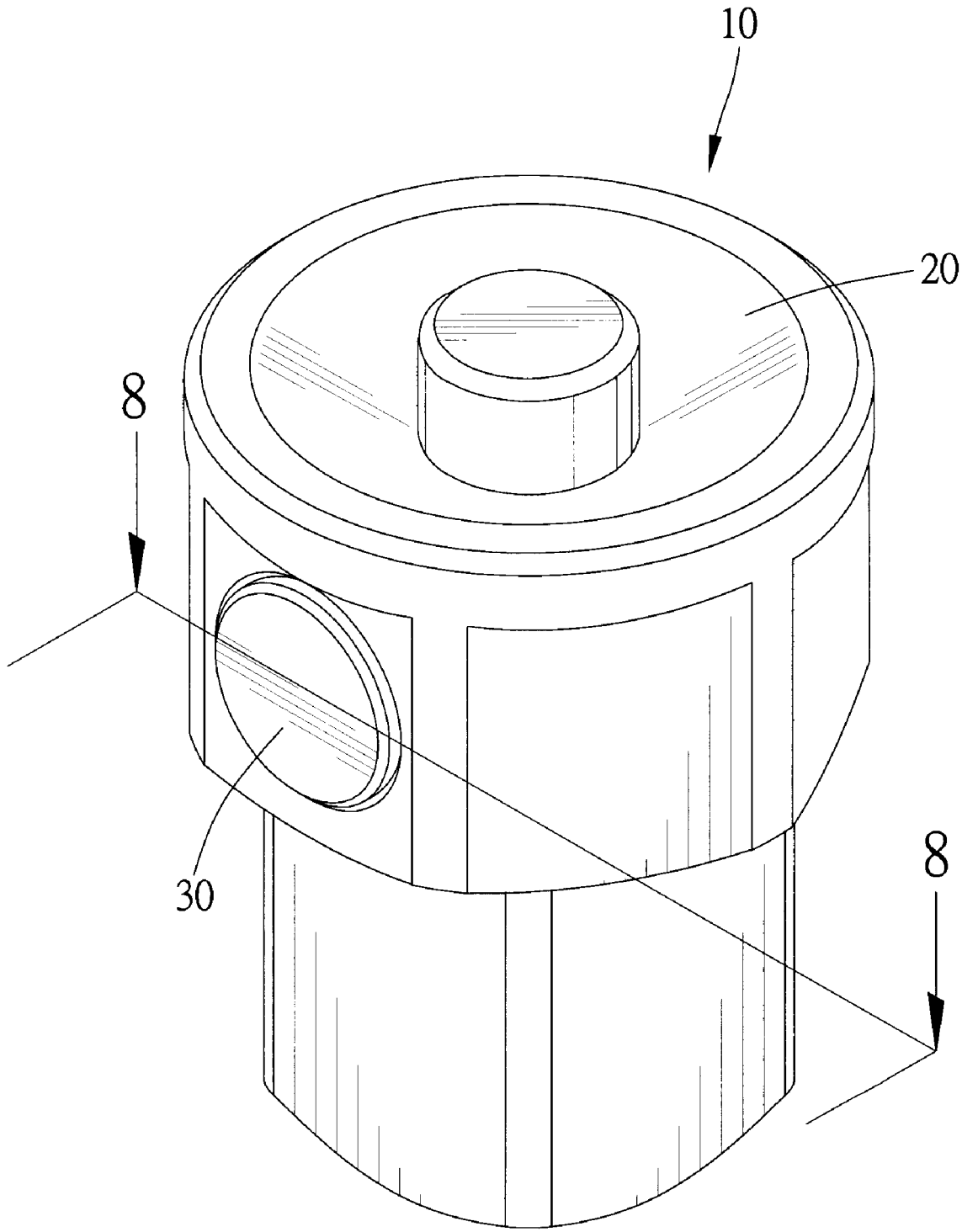
FIG. 6 is a perspective view of an adapter in accordance with a second embodiment of the present invention.
Figure 7:
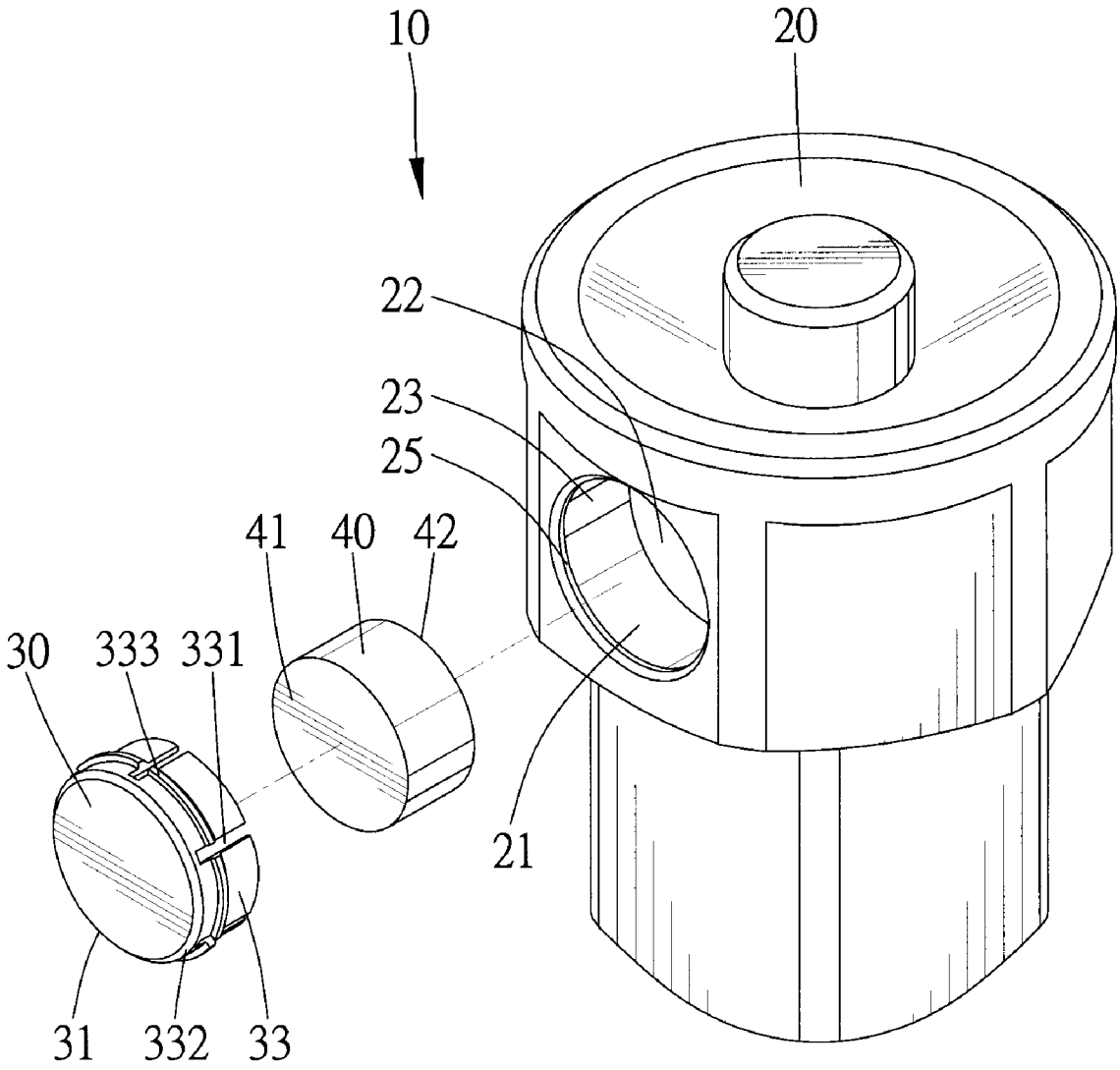
FIG. 7 is an exploded view of the adapter of FIG. 6.
Figure 8:
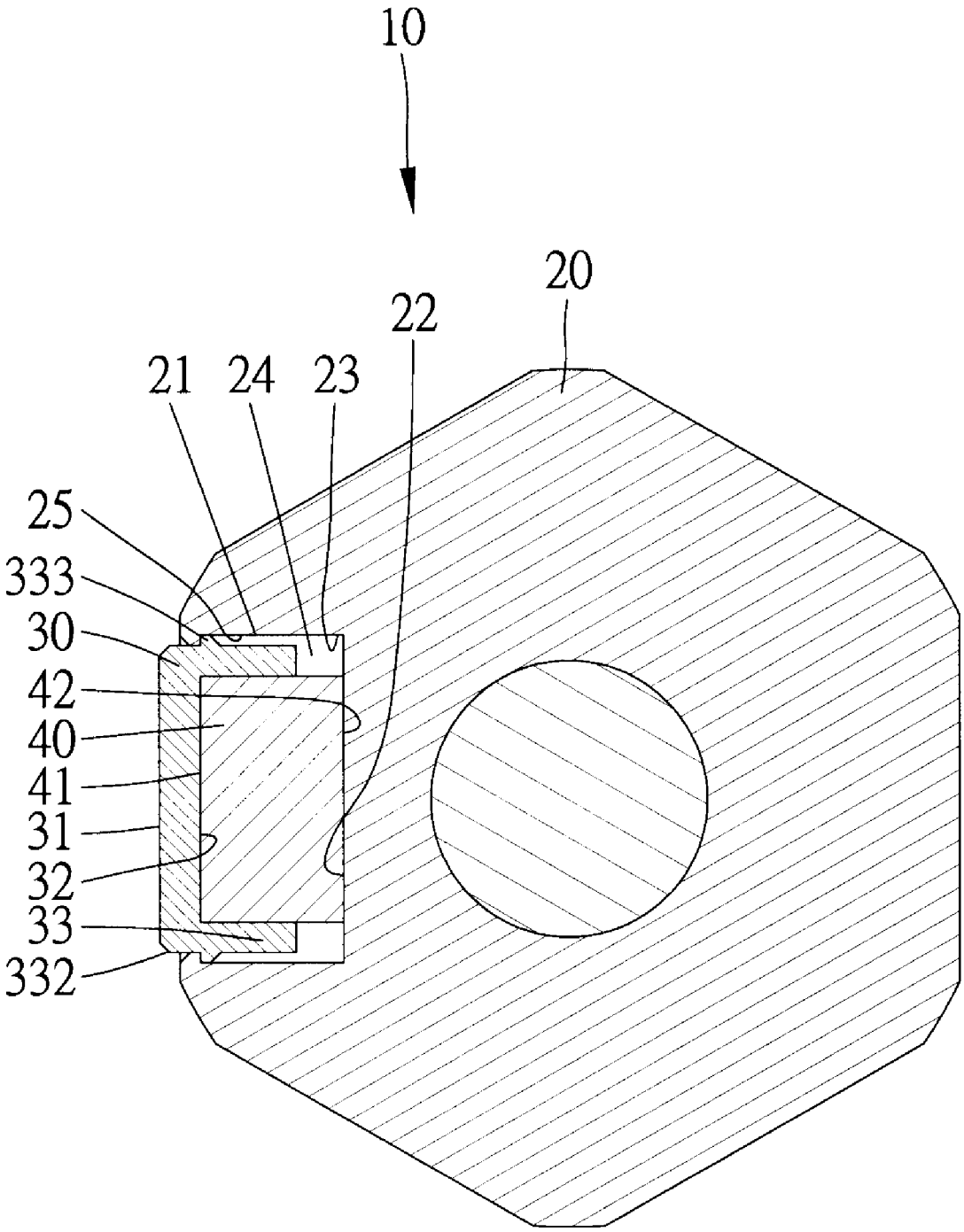
FIG. 8 is a cross-sectional view taken along a line 8-8 in FIG. 6.
Figure 9:
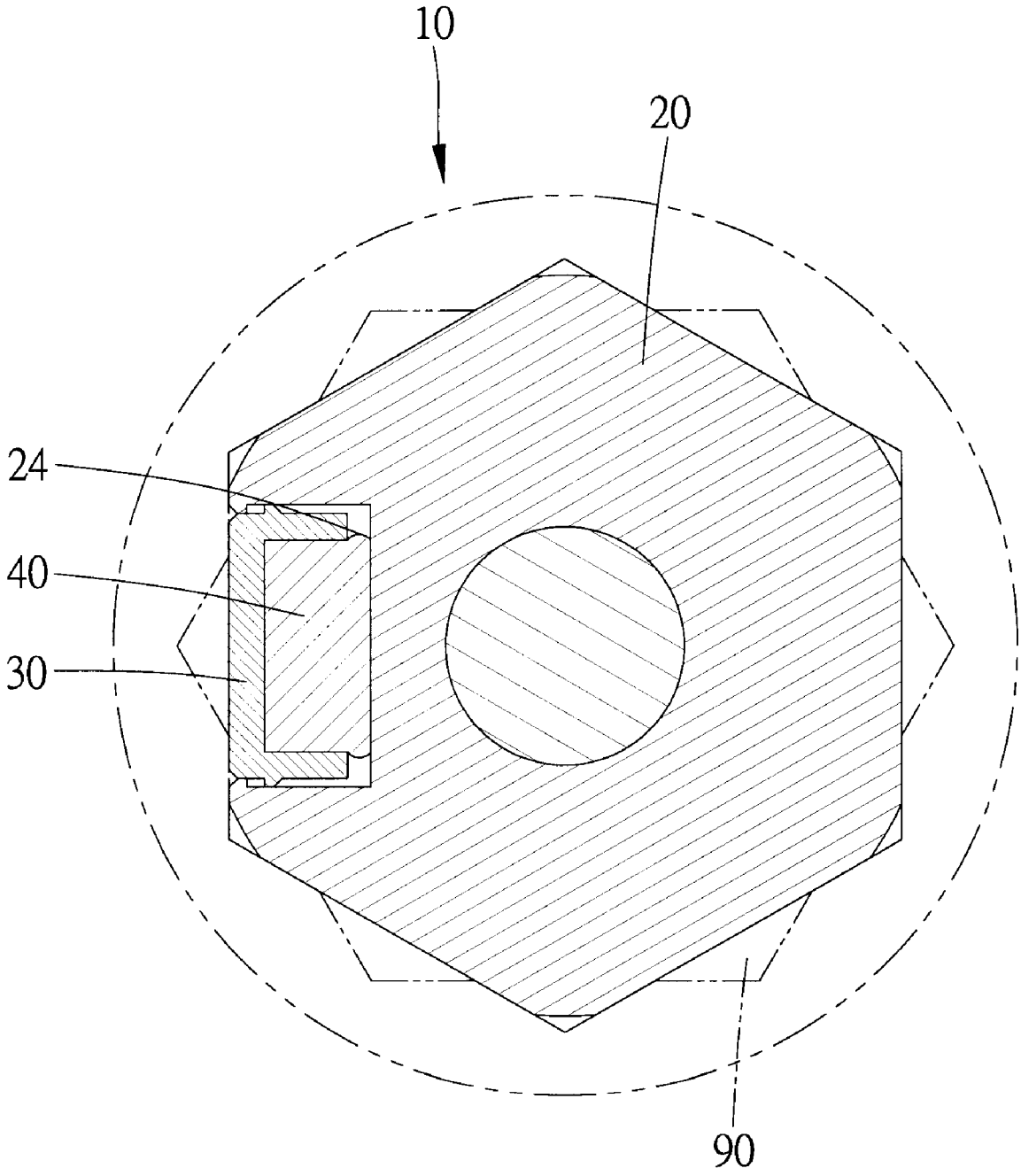
FIG. 9 is a sectional view showing the adapter of FIG. 6 in a driving hole of a tool, with the driving hole shown in phantom.

Prior to engaging the adapter 10 in the hole 90, the surface 31 of the cover is outside the opening of the cavity 21 (as seen in FIG. 3). When the adapter 10 is engaged in the hole 90, the surface 31 is otherwise partially abutted by the wall of the hole 90 (as seen in FIG. 5).

The sloped edge 332 is provided for an easy assessment of the adapter 10 in the hole 90 of the wrench.

The rim 33 is provided for securely hooking the cover 30 in the cavity 21. The rim 33 also delimits a concavity 32 in which the elastic member 40 can be disposed and includes a plurality of slots 331 extended in an axial direction corresponding to that of the rim 33. Preferably, each slot 331 is evenly distributed on the rim 33. The plurality of slots 331 are provided to allow a user to easily depress the rim 33 for easy installation in the cavity 21.

The elastic member 40 takes the form of a column and includes a first end surrounded by the rim 33 and a second end outside the rim 33 and abutted by the bottom wall 22 of the cavity 21. Preferably, the first and second ends are planar so as to provide evenly distributed force. The elastic member 40 is made of resilient material such as Ployurethane, or Polypropylene, or Polyvinylchloride, therefore, the adapter 10 will not attract any metallic scraps or dust.

When the adapter 10 is not engaged in the hole 90 of the wrench (as seen in FIG. 3), the elastic member 40 has a first height, namely, the first distance between the first and second ends. When the adapter 10 is engaged in the hole 90 of the wrench (as seen in FIG. 5), the elastic member 40 has a second height, namely the second distance between the firs and second ends, lesser than the first height so that the surface 31 of the cover 30 can be displaced from outside the opening of the cavity 21 (FIG. 3) to within the cavity 21 (FIG. 5). Moreover, the second end extends radially outward toward gap 24 defined between wall 23 of the cavity 21 and the elastic member 40 as a result of reduction in the height of the elastic member 40.

Turning now to FIGS. 6 through 9, there is shown a second embodiment embodying the present invention. In this embodiment, the cavity 21 further includes an indentation 25 circumferentially extending from the wall 23 of the cavity 21. Also, the rim 33 of the cover 30 further includes a flange 333 that can be received in the indentation 25. As such, the cover 30 is more securely hooked in the cavity 21.

Figure 10:
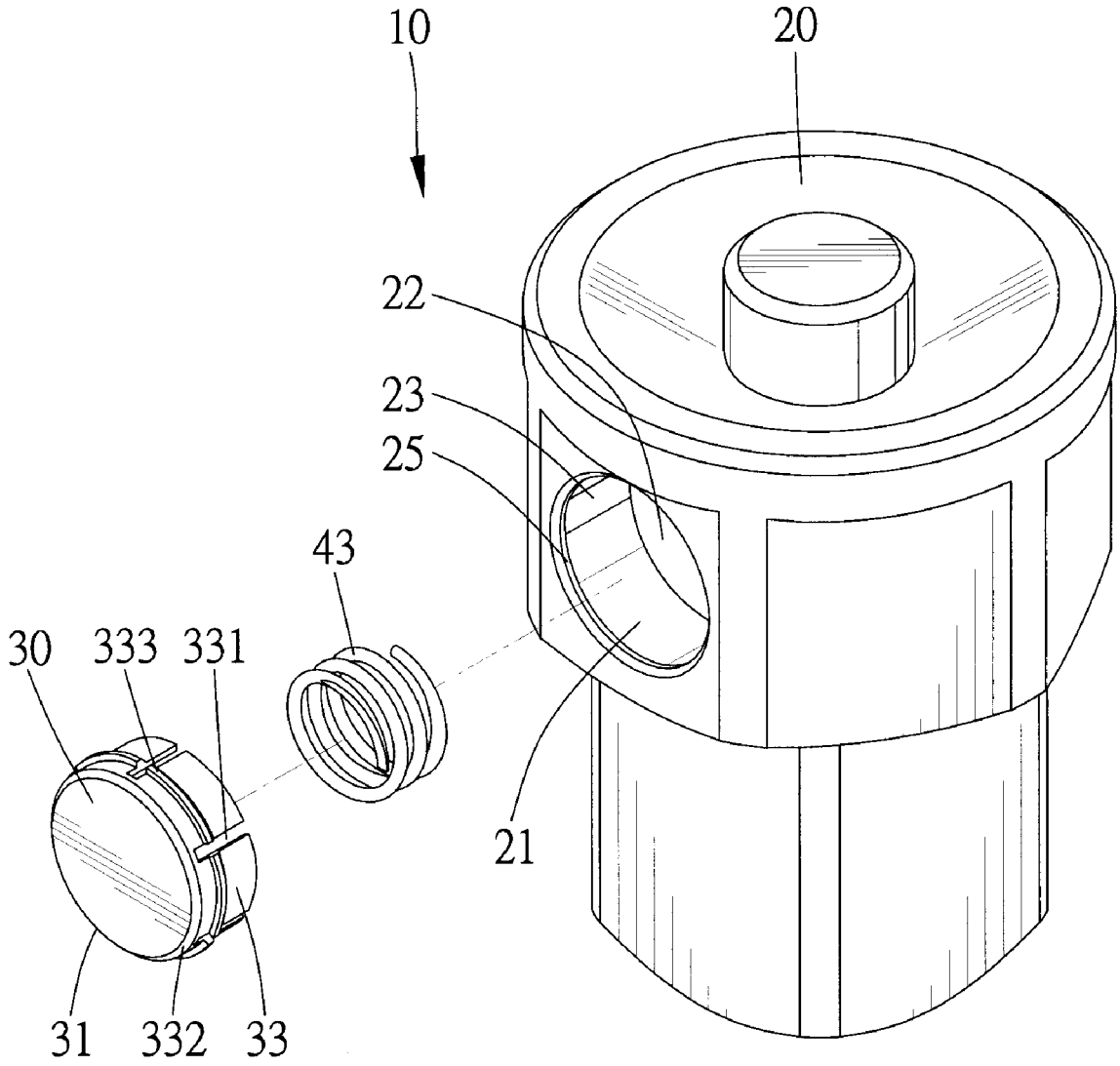
FIG. 10 is an exploded perspective view of an adapter in accordance with a third embodiment of the present invention.

Turning now to FIG. 10, there is shown a third embodiment embodying the present invention. In this embodiment, the elastic element 40 takes the form of a coil spring and the spring is configured to provide evenly distributed force to the cover 30.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. An adapter engagable in a hole of a driving end of a tool comprising:

a body disposed in the hole and including an outer surface having a cavity formed therein, the cavity defining a side wall extending from a bottom wall;

a cover capturing an elastic member against the bottom wall of the cavity to displaceably protrude outward from the outer surface of the body, the cover coaxially receiving a first end portion of the elastic member, the cover including a top surface and a depressible rim extending axially therefrom to be disposed peripherally about the first end portion of the elastic member, the depressible rim thereby extending axially along a portion of the elastic member to be captured against the side wall of the cavity, the elastic member being abutted by the cover and the bottom wall of the cavity, the elastic member including a second end portion having a section exposing outside the cover within the cavity, the exposed section of the elastic member being spaced by a gap from the side wall of the cavity;

whereby the cover is linearly displaceable responsive to the elastic member; and wherein when the elastic member is depressed, the elastic member is compressed while remaining partially disposed within the depressible rim of the cover.

2. The adapter according to claim 1 wherein the cover defines a sloped edge extended from the surface to the depressible rim .

3. The adapter according to claim 2 wherein the first end portion of the elastic member is surrounded by the depressible rim, and the second end portion is disposed outside the depressible rim and abutted by the bottom wall of the cavity.

4. The adapter according to claim 3 wherein the elastic member is made of resilient material, and is deflectable between a first height configuration and a second height configuration less than that of the first height configuration.

5. The adapter according to claim 3 wherein the elastic member takes the form of a column.

6. The adapter according to claim 3 wherein the elastic member takes the form of a coil spring.

7. The adapter according to claim 2 wherein the depressible rim forms a concavity coaxially receiving the elastic member.

8. The adapter according to claim 2 wherein the depressible rim is formed with a plurality of slots extended in an axial direction.

9. The adapter according to claim 8 wherein the plurality of slots are evenly distributed.

10. The adapter according to claim 2 wherein the cover further comprises a flange, and wherein the cavity further includes an indentation circumferentially extending from the side wall of the cavity for retentively engaging the flange.

11. The adapter according to claim 10 wherein the elastic member defines a first end portion surrounded by the depressible rim, and the second end portion is disposed outside the depressible rim and abutted by the bottom wall of the cavity.

12. The adapter according to claim 10 wherein the elastic member delimits a concavity in which the elastic member can be disposed.

13. The adapter according to claim 12 wherein the elastic member is made of resilient material, and is deflectable between a first height configuration and a second height configuration less than that of the first height configuration.

14. The adapter according to claim 10 wherein the depressible rim is formed with a plurality of slots extended in an axial direction.

15. The adapter according to claim 14 wherein the plurality of slots are evenly distributed.

16. The adapter according to claim 10 wherein the elastic member takes the form of a column.

17. The adapter according to claim 10 wherein the elastic member takes the form of a coil spring.

* * * * *